US008561242B2

(12) United States Patent
Brueckner et al.

(10) Patent No.: US 8,561,242 B2
(45) Date of Patent: Oct. 22, 2013

(54) FLOOR TREATING APPARATUS

(71) Applicant: Alfred Kärcher GmbH & Co. KG, Winnenden (DE)

(72) Inventors: Joerg Brueckner, Gerlingen (DE); Ernst Lorenz, Groβbottwar (DE); Andreas Renz, Leutenbach (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/749,613

(22) Filed: Jan. 24, 2013

(65) Prior Publication Data

US 2013/0133146 A1 May 30, 2013

Related U.S. Application Data

(63) Continuation of application No. PCT/EP2010/060919, filed on Jul. 27, 2010.

(51) Int. Cl.
*A47L 11/03* (2006.01)
*A47L 11/283* (2006.01)

(52) U.S. Cl.
USPC ..... 15/50.1

(58) Field of Classification Search
USPC ..... 15/320, 50.1, 98
See application file for complete search history.

(56) References Cited

U.S. PATENT DOCUMENTS

| | | | | |
|---|---|---|---|---|
| 2,668,306 | A | | 2/1954 | Kohl |
| 3,186,022 | A | * | 6/1965 | Forslund ..... 15/345 |
| 3,466,690 | A | | 9/1969 | Cooper |
| 4,432,472 | A | | 2/1984 | Lamm |
| 4,524,477 | A | | 6/1985 | Williams, III et al. |
| 5,765,250 | A | | 6/1998 | Lee |
| 5,896,617 | A | * | 4/1999 | Kasen et al. ..... 15/320 |
| 5,901,408 | A | | 5/1999 | Miller et al. |

FOREIGN PATENT DOCUMENTS

| | | | |
|---|---|---|---|
| JP | 10-57289 | * | 3/1998 |
| WO | WO 2004//064592 | | 8/2004 |

* cited by examiner

*Primary Examiner* — Mark Spisich
(74) *Attorney, Agent, or Firm* — Womble Carlyle Sandridge & Rice, LLP

(57) ABSTRACT

A floor treating apparatus is provided, including a support device, on the lower side of which there is held at least one floor treating tool, which is driven to rotate or oscillate, a handle device to guide the floor treating apparatus in at least one working position, which handle device is held on the support device so as to be pivotable about a pivot axis from the at least one working position into at least one parking position and vice versa, and a storage container for a treatment liquid. The floor treating apparatus includes a storage container receptacle, in which the storage container can be releasably positioned in the at least one working position of the handle device, and a securing device with at least one first securing member and at least one second securing member which can be moved relative thereto.

32 Claims, 6 Drawing Sheets

FLOOR TREATING APPARATUS

CROSS-REFERENCE TO RELATED APPLICATIONS

This application is a continuation of international application number PCT/EP2010/060919, filed on Jul. 27, 2010, the content of which is incorporated by reference herein in its entirety and for all purposes.

FIELD OF THE INVENTION

The present invention relates to a floor treating apparatus, comprising a support device, on the lower side of which there is held at least one floor treating tool, which is driven to rotate or oscillate, a handle device to guide the floor treating apparatus in at least one working position, which handle device is held on the support device so as to be pivotable about a pivot axis from the at least one working position into at least one parking position and vice versa, and a storage container for a treatment liquid, which can be applied to the floor surface to be treated.

BACKGROUND OF THE INVENTION

A floor treating apparatus of this type, which is configured as a so-called single disc floor cleaning machine, is described in U.S. Pat. No. 5,765,250. As a floor treating tool for the floor surface, the single disc machine has a cleaning brush that can be rotated about a vertical rotational axis. Using the cleaning brush, dirt can be detached from the floor surface to be cleaned, wherein to increase the cleaning effect, a cleaning liquid stored in the storage container can be applied to the floor surface. The handle device is lockable in a plurality of working positions, in which it adopts different angles with respect to the horizontal, so that it can be adapted to the requirements of the respective user. Furthermore, the single disc machine can be stored in a space-saving manner, in that the handle device is pivoted into a parking position relative to the support device in such a way that it is oriented horizontally and comes to abut the support device. The single disc machine can then be set upright by 90° so that the handle device receives a vertical orientation, and is put away in a space saving manner.

An object of the present invention is to develop a floor treating apparatus of the above general type in such a way that it can be handled more easily.

SUMMARY OF THE INVENTION

In an aspect of the invention a floor treating apparatus comprises a support device, on the lower side of which there is held at least one floor treating tool, which is driven to rotate or oscillate, a handle device to guide the floor treating apparatus in at least one working position, which handle device is held on the support device so as to be pivotable about a pivot axis from the at least one working position into at least one parking position and vice versa, and a storage container for a treatment liquid, which can be applied to the floor surface to be treated. The floor treating apparatus comprises a storage container receptacle, in which the storage container is releasably positionable in the at least one working position of the handle device, and a securing device with at least one first securing member and at least one second securing member which is movable relative thereto, said securing members being transferable, by pivoting the handle device into the at least one parking position, into a securing position, in which they cooperate to secure the storage container in the storage container receptacle.

BRIEF DESCRIPTION OF THE DRAWING FIGURES

The foregoing summary and the following description may be better understood in conjunction with the drawing figures, of which:

DETAILED DESCRIPTION OF PREFERRED EMBODIMENTS OF THE INVENTION

Figure 1:
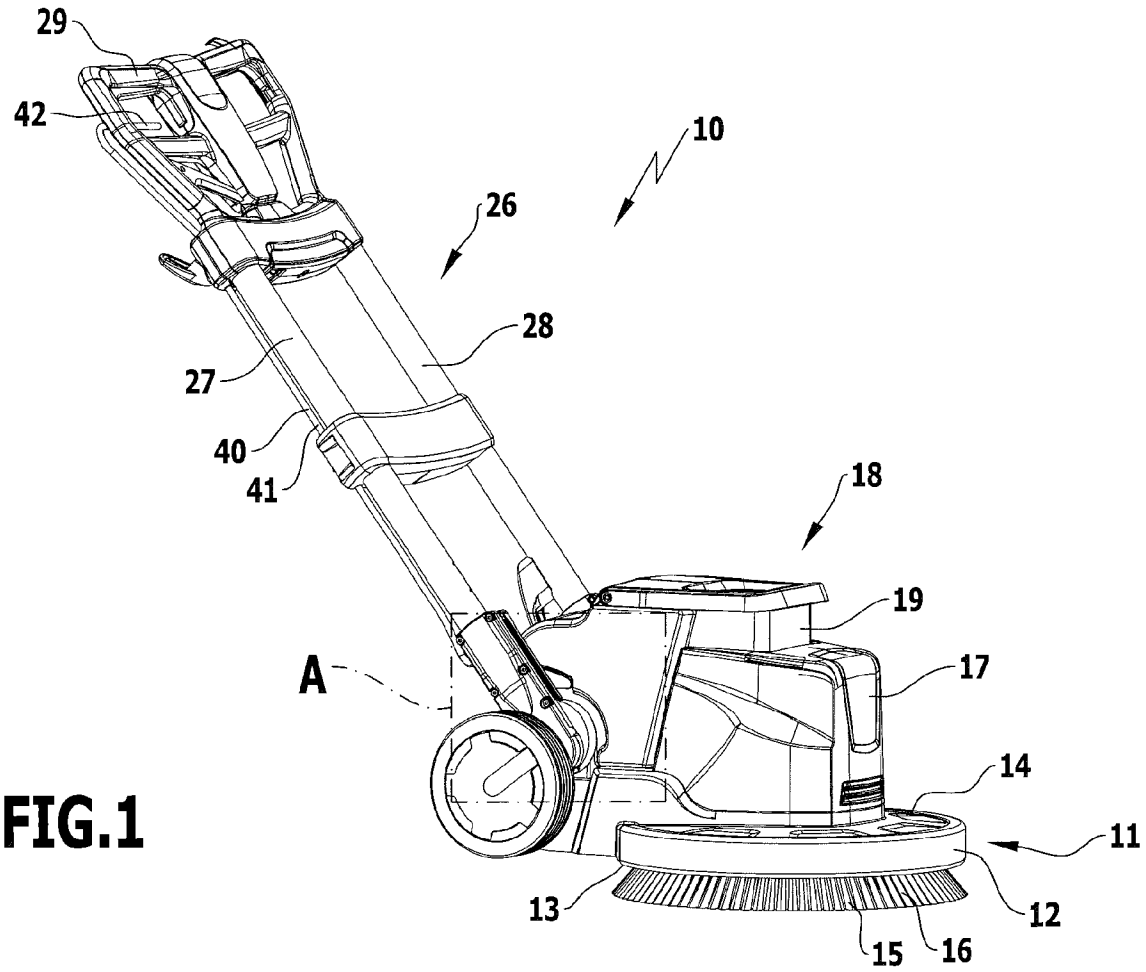
FIG. 1 shows a perspective view of a floor treating apparatus according to an aspect of the invention with a handle device adopting a working position and a storage container for a treatment liquid.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a floor treating apparatus, comprising a support device, on the lower side of which there is held at least one floor treating tool, which is driven to rotate or oscillate, a handle device to guide the floor treating apparatus in at least one working position, which handle device is held on the support device so as to be pivotable about a pivot axis from the at least one working position into at least one parking position and vice versa, and a storage container for a treatment liquid, which can be applied to the floor surface to be treated. The floor treating apparatus comprises a storage container receptacle, in which the storage container is releasably positionable in the at least one working position of the handle device, and a securing device with at least one first securing member and at least one second securing member which is movable relative thereto, said securing members being transferable, by pivoting the handle device into the at least one parking position, into a securing position, in which they cooperate to secure the storage container in the storage container receptacle.

If the handle device adopts the at least one working position, the storage container can be positioned in the storage container receptacle by the user and removed again therefrom. This allows the storage container to be transported, for example to pour in the treatment liquid or to empty it, at a site located remote from the floor treating apparatus. As a result, transportation of the entire floor treating apparatus can be dispensed with. This facilitates handling of the floor treating apparatus for the user. Handling is particularly facilitated for the user if the storage container can be positioned without tools in the storage container receptacle and can be removed therefrom without tools.

In addition, the floor treating apparatus comprises the securing device with the cooperating securing members, which are transferable, by pivoting the handle device into the at least one parking position, into a securing position. In the securing position, the at least one first and the at least one second securing member can cooperate, so that the storage container is secured in the storage container receptacle. As a result, the storage container cannot fall out of the storage container receptacle or be removed therefrom, for example during transportation or stowage of the floor treating apparatus. Even though it is possible for the user to releasably position the storage container in the storage container receptacle when the handle device adopts the at least one working position, it only requires the pivoting of the handle device into the at least one parking position to secure the storage container in the storage container receptacle. This considerably facilitates handling of the floor treating apparatus for the user.

It is advantageous if the storage container is securable solely by means of the securing device in the storage container receptacle when the handle device adopts the at least one parking position. This allows an additional securing or locking of the storage container to be dispensed with and allows a simpler structural configuration of the floor treating apparatus.

In a simple structural configuration of the floor treating apparatus, the at least one first securing member is held on the handle device, and the at least one second securing member is held on the storage container. This allows the movability of the at least one first and the at least one second securing member relative to one another to be ensured in a technically simple manner, for example in a storage container arranged on the support device. The securing members can be moved relative to one another by pivoting the handle device about the pivot axis and transferred into the securing position.

It is advantageous if the at least one first securing member and/or the at least one second securing member are configured as projections projecting from the handle device in the direction of the storage container and from the storage container in the direction of the handle device, respectively. This also allows a simple construction of the floor treating apparatus, wherein the projections can be moved relative to one another by pivoting the handle device and can be transferred into the securing position. The projections can, in particular, be configured as cams held on the handle device and/or on the storage container.

In a different type of embodiment of the floor treating apparatus it can be provided that a projection, which can enter a corresponding recess of the storage container or the handle device, is only provided on the handle device or only on the storage container.

The at least one first securing member and the at least one second securing member preferably form stops that are effective along a removal direction of the storage container from the storage container receptacle. By means of the two stops, a structurally simple and nevertheless effective securing of the storage container against removal from the storage container receptacle can be ensured.

The stops can, in particular, be stop faces running transverse to the removal direction which, for example, are arranged on projections of the handle device and/or of the storage container.

It is advantageous if the at least one first securing member and the at least one second securing member are located in a common plane oriented perpendicular to the pivot axis and are spaced apart to an identical extent from the pivot axis. This allows the securing members to be transferred into the securing position in a clearly defined relative movement with respect to one another. The securing members, in a way, each lie on one side of an angle, the apex of which lies on the pivot axis. If the securing members, as mentioned above, are held on the handle device or on the storage container, they can thereby be made to cooperate in a structurally simple manner, for example to abut one another or can be removed from one another for decoupling.

The spacing of the at least one first securing member from a free end of the handle device is preferably smaller than the spacing of at least one joint from the free end, with which joint the handle device is pivotably held on the support device. This allows a simpler construction of the handle device, in which the at least one joint can be arranged at the end on a lower end in relation to a height direction of the floor treating apparatus. The at least one first securing member is arranged above the at least one joint in relation to the height direction and does not project beyond the pivot axis in the direction of the floor surface. This allows a structurally simpler configuration of the floor treating apparatus, in particular when the storage container is positioned on the upper side of the support device and the at least one second securing member is held on the storage container.

It may be provided that the at least one second securing member has a smaller spacing from the lower side of the floor treating apparatus than the at least one first securing member, especially with the securing members held on the handle device and on the storage container when the storage container is positioned on the support device. As a result, the at least one first securing member can be pivoted over the pivot axis to the at least one second securing member so that it therewith secures the storage container against removal from the storage container receptacle in the height direction of the floor treating apparatus.

The at least one second securing member is advantageously integrally formed with a wall of the storage container in order to give the storage container a simpler construction. The at least one second securing member is, for example, a projection projecting from a plane defined by the wall or a projection, which is formed by a step of the wall. The wall is preferably a side wall of the storage container.

In particular, in the last-described embodiment, it is advantageous if the storage container is a plastics material moulded part, in order to form the at least one second securing member integrally with the wall.

It is advantageous if the at least one second securing member is arranged laterally on the storage container as this allows the floor treating apparatus to be given a structural simple configuration. The handle device can, for example, comprise a handle strut, which can pivot laterally past the storage container about the pivot axis from the at least one working position into the at least one parking position. In addition there can be arranged on the handle strut and on the storage container a respective projection or a recess for a projection, which by pivoting the handle strut can be brought closer to one another and can be transferred into a securing position, in which they can cooperate to secure the storage container.

The handle device preferably comprises two handle struts spaced apart from one another, between which is arranged the storage container in order to achieve a configuration of the floor treating device which is just as robust as it is structurally simple. In the at least one working position of the handle device, the storage container can be positioned between the handle struts, which, when being pivoted into the at least one parking position, can likewise be pivoted past the storage container to secure it. The handle struts may be connected to one another at the free ends, so the handle device forms a substantially U-shaped handle bow.

In order to ensure a defined transfer of the at least one first securing member and the at least one second securing member into the securing position, it is advantageous if the floor treating apparatus comprises a guide path to guide at least one securing member during pivoting of the handle device from the at least one working position into the at least one parking position and vice versa.

The guide path is preferably arcuate and in particular a circular arc with respect to the pivot axis. For example, this allows a first securing member held on the handle device to be guided along a defined (circular) arc when the handle device is pivoted about the pivot axis.

The guide path can be formed in a structurally simple manner if the guide path is formed integrally with a wall of the storage container, in particular a side wall of the storage container. The guide path is, for example, formed on a step of the wall, the step segments of which are axially spaced apart from one another with respect to the pivot axis and it advantageously has a contour of circular arcuate shape.

Furthermore, a step of two wall segments axially spaced apart with respect to the pivot axis may be formed in the wall, so that formed in the region of the step is a recess of the storage container, in which a joint can be arranged to mount the handle device on the support device. This allows a compact design of the floor treating apparatus.

The guide path is preferably arranged laterally on the storage container in order, for example, to allow guidance of the at least one first securing member, when the handle device is pivotable laterally past the storage container from the at least one working position into the at least one parking position and vice versa.

In a structurally simple configuration, the at least one second securing member is formed as a radial projection, with respect to the pivot axis, of a limit member of the guide path, in other words, in a way, an end termination of the guide path in the peripheral direction of the pivot axis. This ensures that the guided securing member can correctly be brought closer to the securing member cooperating with it in the securing position.

It may furthermore be provided that a guide path for the at least one second securing member is also arranged on the handle device, the at least one first securing member being able to form a termination of the guide path in the peripheral direction of the pivot axis.

The at least one first securing member and the at least one second securing member are advantageously transferable, by pivoting the handle device from the at least one parking position into the at least one working position, from the securing position into a release position, in which they do not cooperate. In the release position, the securing members do not cooperate and therefore do not secure the storage container against removal from the storage container receptacle. For example, the at least one first and the at least one second securing member are disengaged in the release position or arranged at a spacing with respect to one another transverse to a removal direction of the storage container from the storage container receptacle. This can be implemented in a structurally simple manner if the securing members are pivotable relative to one another about the pivot axis, for example when they are held on the handle device or on the storage container.

The storage container receptacle is preferably formed on an upper side of the support device, so the storage container can be placed in a user-friendly and easy-to-handle manner from above on the support device and can be lifted up therefrom. Furthermore, the movability of an at least one first securing member held on the handle device and an at least one second securing member held on the storage container relative to one another can thus be ensured in a structurally simple manner. In addition, in this embodiment of the floor treating apparatus, the handle device can be relieved of the load and the user is spared from supporting the load of the storage container on the handle device while working. Moreover, owing to the load of the storage container on the support device, an increased contact pressure of the floor treating tool on the floor surface, and therefore an improved treating result, can be achieved.

As mentioned at the outset, the treatment liquid from the storage container can be applied to the floor surface. It is advantageous for this if the storage container has a valve for the treatment liquid to discharge and if the floor treating apparatus comprises a valve actuating device with at least one first actuating member and at least one second actuating member cooperating therewith to actuate the valve. By acting on the at least one first actuating member, the latter can cooperate with the at least one second actuating member, so the treatment liquid can discharge from the storage container. The at least one second actuating member may, in particular, be a valve body of the valve itself such as, for example, a valve plunger.

The valve is advantageously installed in a base wall of the storage container. This provides the possibility of the treatment liquid being able to run out of the storage container by gravitational force when the valve is open. As a result, a separate pump to dispense the treatment liquid can be dispensed with. The valve may be configured as a check valve in a structurally simple configuration, which can be closed under the influence of gravity. In addition or alternatively, a biasing element, for example a compression spring, can be provided to transfer the valve into a closure position.

The at least one first actuating member is preferably held on the handle device, and the at least one second actuating member is held on the storage container, in order to achieve a simple structural configuration of the floor treating apparatus.

The at least one first actuating member and the at least one second actuating member are advantageously decoupled from one another in the at least one working position of the handle device or can be decoupled by removing the storage container from the storage container receptacle, in order to allow the manual release, and in particular the release without tools, of the storage container from the storage container receptacle. The at least one first and the at least one second actuating member are, for example, disengaged or in releasable engagement, in particular manually releasable engagement, or the at least one second actuating member does not engage behind or undercut the at least one first actuating member in a direction opposing the removal direction of the storage container. This allows particularly easy handling of the floor treating apparatus.

In particular, when the storage container, which can be removed upwardly from the storage container receptacle, is arranged on the support device, it is advantageous if a portion of the at least one second actuating member cooperating with the at least one first actuating member is arranged above the at least one first actuating member. This provides the possibility of mutually decoupling the at least one second actuating member held on the storage container from an at least one first actuating member held on the handle device by lifting the storage container. Nevertheless, the actuating members can cooperate to actuate the valve by a relative movement directed towards one another.

In a particularly advantageous embodiment of the floor treating apparatus, it is advantageous if at least one securing member forms an actuating member, in particular if the at least one first securing member forms the at least one first actuating member. As a result, the floor treating apparatus can be given a particularly simple structural design. The at least one first securing member, especially the cam-like projection mentioned above, can be used in the at least one working position of the handle device to actuate the valve and in the at least one parking position to secure the storage container in the storage container receptacle.

Advantageously, the at least one first actuating member is movably mounted on the handle device and, in particular, displaceably mounted along the longitudinal direction thereof. This allows a reliable functioning of the valve actuating device. Owing to the movable mounting, the at least one first actuating member can move along a clearly defined path, in order to thus cooperate in a specific manner with the at least one second actuating member.

It is advantageous if the valve actuating device comprises a triggering element for a user, the triggering element being arranged on the handle device and coupled to the at least one first actuating member. The triggering element, for example a tie rod with an actuating handle arranged thereon on a free end, allows a user-friendly and defined action on the at least one actuating member, in order to actuate the valve.

As already mentioned, the at least one second actuating member can be held on the storage container. It is advantageous here if the at least one second actuating member is movably mounted on the storage container, in particular is configured as an actuating lever that can be tilted about a tilting axis. Owing to the lever, it is possible to transfer a movement from one side of the storage container to a further, remote side of the storage container. This, for example, provides the possibility for the actuating members to cooperate laterally on the storage container, in order to actuate a valve installed in the base wall of the storage container. The movable mounting of the at least one second actuating member ensures a reliable functioning of the valve actuating device.

It can be provided that the tilting axis is oriented parallel to the pivot axis, in order to simplify the structural configuration of the surface treating apparatus. The at least one first actuating member and a portion of the at least one second actuating member cooperating therewith may, for example, be arranged in a common plane oriented perpendicular to the pivot axis and to the tilting axis. This facilitates the ensuring of defined relative positions of the actuating members relative to one another when pivoting the handle device from a working position into a further working position.

The at least one second actuating member is preferably arranged laterally on the storage container, in order to allow a structurally simple configuration of the floor treating apparatus. This is advantageous, in particular, if the at least one first actuating member is held on the handle device and the latter can be pivoted laterally past the storage container. The at least one first actuating member is, in this embodiment, advantageously a projection of the handle device in the direction of the storage container and the at least one second actuating member is a lever held on the storage container.

The at least one second actuating member advantageously has a first portion arranged laterally on the storage container and a second portion arranged below the storage container. As described above, this allows the at least one first actuating member—for example a lever—to be actuated laterally on the storage container, but allows the effect of the actuation to appear on a valve installed in the base wall of the storage container. The at least one second actuating member is advantageously adapted in this embodiment to the outer contour of the storage container in a space-saving manner.

It is advantageous if the at least one second actuating member on a side facing the at least one first actuating member has an arcuate contour, in particular a circular arcuate contour with respect to the pivot axis. A first actuating member held on the handle device and pivoted therewith about the pivot axis can thus follow the contour of the second actuating member. Upon a radial movement of the first actuating member with respect to the pivot axis to actuate the valve, even with different working positions of the handle device, reliable cooperation of the actuating members can thereby be ensured.

The contour of the at least one second actuating member may be formed as an extension of a guide path for a securing member, in particular for the at least one first securing member. This is advantageous, in particular, if the at least one first securing member forms the at least one first actuating member. If the handle device is pivoted from the at least one working position into the at least one parking position and vice versa, the at least one first securing and actuating member therefore moves along a defined path. This can ensure that the latter is guided into the position required to secure the storage container and to actuate the valve.

As mentioned at the outset, the floor treating apparatus can be used for cleaning. An advantageous embodiment of the floor treating apparatus according to an aspect of the invention is a floor cleaning machine, especially with a floor treating tool in the form of a cleaning brush that can be rotated about a vertical axis. A cleaning liquid such as water, to which a cleaning chemical can be added, is preferably contained in the storage container.

The floor treating apparatus may, alternatively or additionally, be configured as a floor polishing machine, the floor processing tool of which is a polishing disc that can be rotated about a vertical axis. The treatment liquid may, for example, be a polishing solution here. A use of the floor treating apparatus as a sanding machine is also conceivable.

FIG. 1 shows a perspective view of a preferred embodiment of a floor treating apparatus according to an aspect of the invention, which is configured as a combined floor cleaning and floor polishing machine and will be designated a single disc machine 10 below.

The single disc machine 10 comprises a support device 11 approximately defining a horizontal plane and called the base 12 below, with a lower side 13 and an upper side 14. A floor treating tool 15, in the present case a cleaning brush 16 in the form of a disc, which can be driven to rotate about a vertical axis, is held on the lower side 13. The cleaning brush 16 can be driven by means of a drive device, not shown, positioned on the upper side 14 and covered by a motor housing 17.

When using the single disc machine 10 as a floor cleaning machine, the cleaning brush 16 is used. If the cleaning brush 16 is exchanged for a polishing disc, the single disc machine 10 can be used as a floor polishing machine.

Furthermore, the single disc machine 10 comprises a storage container 18, hereinafter tank 19, which can be releasably positioned on the upper side 14 of the base 12 for a treatment liquid. When using the single disc machine 10 as a floor cleaning machine, the treatment liquid is preferably water, to which a cleaning chemical can be added to increase the cleaning effect. If the single disc machine 10 is used as a floor polishing machine, the treatment liquid may, for example, be a polishing solution.

Figure 4:
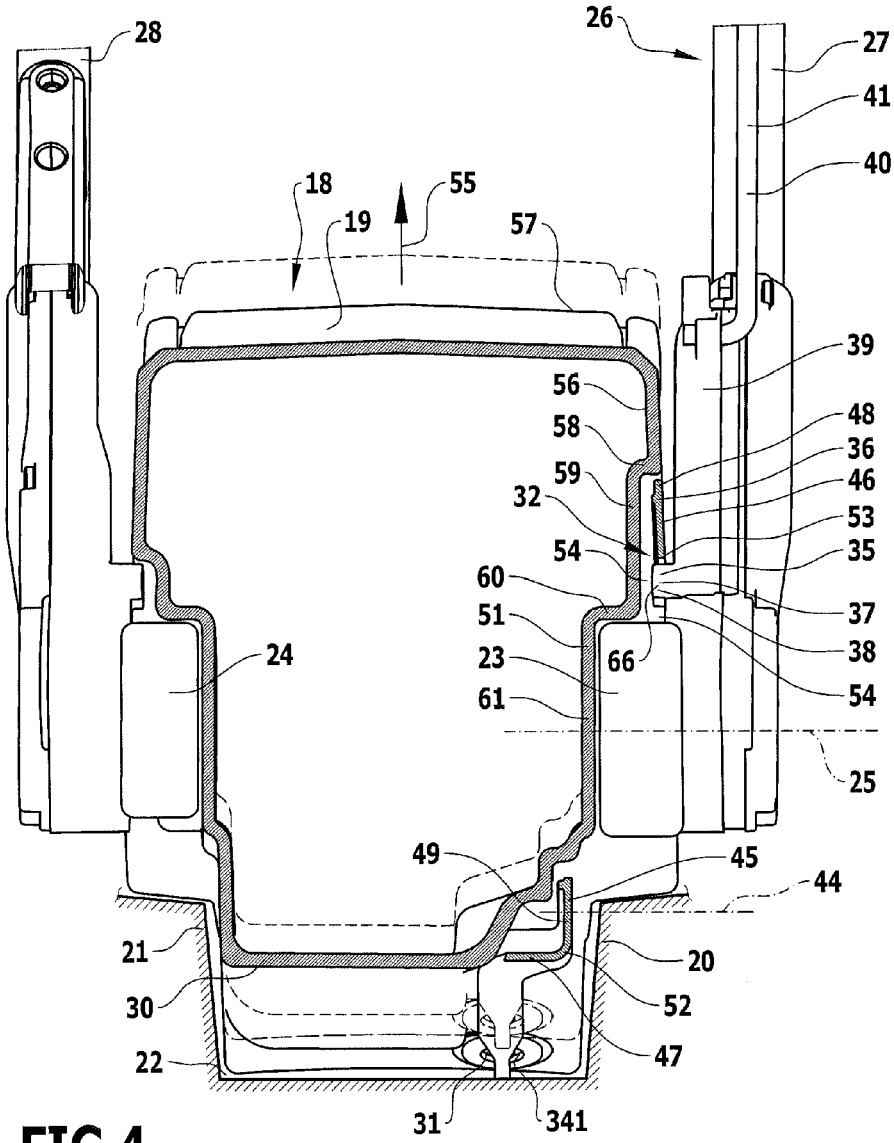
FIG. 4 shows a section along the line 4-4 in FIG. 3, partly in section.

The tank 19 is arranged on a storage container receptacle 22, formed on the upper side 14, limited laterally by two edges 20 and 21 and indicated only schematically in FIG. 4.

Furthermore, the single disc machine 10 comprises a handle device 26, which can be pivoted on the base 12 by means of two joints 23 and 24 about a horizontal pivot axis 25. For this purpose, the handle device 26 has a first, right-hand handle strut 27 and a second, left-hand handle strut 28, which are held on the base 12 so as to be pivotable by means of the joints 23 or 24 above the edges 20 or 21. When the tank 19 is positioned on the base 12, its rear half remote from the motor housing 17 is arranged between the joints 23 and 24. The handle struts 27 and 28 are connected to one another by means of a handle unit 29 for the user at their free ends remote from the base 12.

Figure 3:
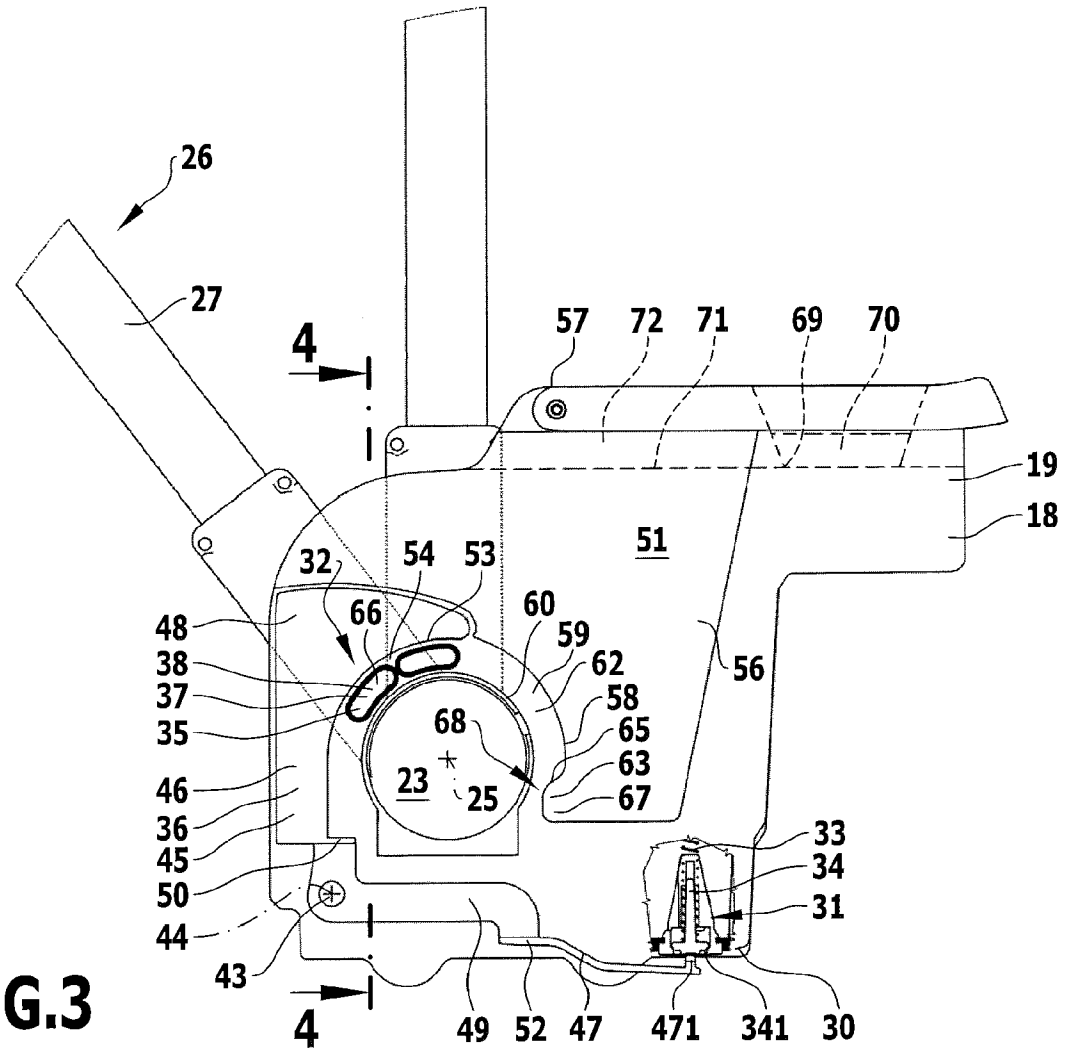
FIG. 3 shows a schematic side view of the storage container of the floor treating apparatus from FIG. 1 and its handle device in two different working positions, partly in section.

A user can take hold of the handle unit 29 in a known manner in order to guide the single disc machine 10 over a floor surface to be treated when the handle device 26 adopts a working position. In the working position, the handle device 26 generally encloses an angle of about 0° to about 45° with the vertical, with it pointing away from the base 12 (FIGS. 1 and 3). The handle device 26 can be pivoted about the pivot axis 25 and locked in a plurality of working positions on the base 12, in which it encloses different angles with the base 12. This provides the possibility of adapting the handle device 26 to the requirements of the respective user.

So that a treatment liquid contained in the tank 19 can discharge therefrom, the single disc machine 10 comprises a valve 31 installed in a base wall 30 of the tank 19 and a valve actuating device 32 to actuate it. The valve 31 is a check valve, which seals the base wall 30 under the influence of its own gravitational force and the gravitational force weighing on it of the treatment liquid and furthermore under the influence of a biasing element in the form of a restoring spring 33. There acts as a valve body a vertical valve pin 34, the lower end of which is arranged in a recess 341 of the base wall 30 and does not project beyond the base wall 30.

The valve actuating device 32 comprises two actuating members cooperating with one another, namely a first actuating member 35 on the handle device 26 and a second actuating member 36 on the tank 19.

The first actuating member 35 is a projection 37, which is held on the handle strut 27, in the direction of the tank 19. The projection 37 forms a cam 38 with an approximately kidney-shaped cross-section with respect to the pivot axis 25. The cam 38 is arranged adjacent to the joint 23 above the pivot axis 25 and formed on a plate-like carrier 39 on the side of the handle strut 27 facing the tank 19 (FIG. 4). The carrier 39 and therefore the cam 38 are movable relative to the handle strut 27 and, in particular, displaceably mounted thereon in the longitudinal direction thereof.

To displace the carrier 39 along the handle strut 27, the valve actuating device 32 has a triggering element 40. The triggering element 40 is fixed to the carrier 39, runs parallel to the handle strut 27, on which it is displaceably mounted, and thus forms a tie rod 41, on the free end of which an angled handle 42 is arranged in the region of the handle unit 29. If a user pulls on the handle 42, the carrier 39, and therefore the cam 38, is displaced along the handle strut 27 by increasing its distance from the pivot axis 25. With a slackening pull, the cam 38 returns to its starting position and for this a carrier 39 is biased in the direction of the joint 23, in a manner not shown.

The second actuating member 36 is a lever 45, which can be tilted at a rear, lower end of the tank 19 by means of a joint 43 about a horizontal tilting axis 44. The lever 45 is divided into a first vertical portion 46 arranged laterally on the tank 19 and a second, approximately horizontal portion 47 arranged below the base wall 30. The first portion 46 is formed in a stepped manner with an upper segment 48 and a lower segment 49 arranged parallel thereto. The segments 48 and 49 merge into one another close to the joint 43 at a step 50, so the first portion 46 is adapted with respect to its contour to a right-hand side wall 51, formed in a stepped manner, of the tank 19. At a further step 52, the lower segment 49 merges into the second portion 47 which rests with a projection 471 on the valve pin 34.

The upper segment 48 approximately has the form of a fin and forms a quarter circle-shaped contour 53 with respect to the pivot axis 25. The contour 53 is formed above the cam 38, so the cam 38 can be pivoted with some play in a quarter circle-shaped path 54 formed between the contour 53 and the joint 23. The contour 53 extends approximately from the vertical to the horizontal in the anti-clockwise direction.

FIG. 3 schematically shows how the cam 38 is located in the path 54, specifically for two different working positions of the handle device 26, the strut 27 of which is also shown schematically. Of this only those features of the handle device 26 are provided with reference numerals, which relate to that working position, in which the handle device 26 encloses an angle of about 55° with respect to the base 12.

In order to actuate the valve 31, the user, as mentioned, can pull on the handle 42, so the cam 38 is pulled in the direction of the handle unit 29. This leads to the cam 38 coming into contact with the upper segment 48 in the region of its contour 53, so the cam 38 and the lever 45 cooperate. A pulling force acting on the handle 42 therefore leads to the tilting of the lever 45 about the tilting axis 44, in the anti-clockwise direction in the view of FIG. 3. As a result, the second portion 47 moves closer to the base wall 30, so the valve pin 34 is pressed into the interior of the tank 19. As a result, treatment liquid contained in the tank 19 can discharge from the valve 31 for application on the floor surface to be treated. If the pulling force on the handle 42 slackens, the lever 45 returns to the original position again owing to the biasing of the restoring spring 33 and the gravitational force weighing on the valve pin 34.

It is possible to actuate the valve 31 independently of the specific working position of the handle device 26, as, owing to the pivoting thereof about the pivot axis 25 relative to the base 12, and therefore to the tank 19, the cam 38 is moved in the path 54. Independently of the angle between the handle device 26 and the base 12, the cam 38 and the lever 45 can therefore cooperate in a working position of the handle device 26.

Even though the cam 38 and the lever 45 can cooperate, the cam 38 and the lever 45 are mechanically decoupled from one another. They are not in engagement with one another and do not engage behind one another or undercut one another. Furthermore, effective locking elements are neither provided between the tank 19 and the base 12 nor between the tank 19 and the motor housing 17. The tank 19 is, instead, placed directly on the base 12 and positioned in the storage container receptacle 22. If the handle device 26 adopts a working position, this allows the tank 19 to be removed from the storage container receptacle 22 in approximately the vertical direction, specifically manually and, in particular, without tools. A prior release of locking elements, which act between the tank 19 and the rest of the single disc machine 10, is unnecessary for this. This provides the user with the possibility, in a handling-friendly manner, of transporting the tank 19 to a site located remote from the single disc machine 10, for example, to fill or empty the tank 19.

The removal of the tank 19 from the storage container receptacle 22 is shown schematically in FIG. 4. Continuous contour lines and the cut walls of the tank 19 shown hatched symbolise the latter here, when it is positioned in the storage container receptacle 22. Contour lines shown by dashed lines symbolise the tank 19, when it is removed in a vertical direction, symbolised by an arrow 55, from the storage container receptacle 22.

In the reverse manner, the tank 19, in a working position of the handle device 26, can be placed in the storage container receptacle 22 manually and, in particular, without tools, and therefore in a manner which is easy for the user to handle.

Figure 2:
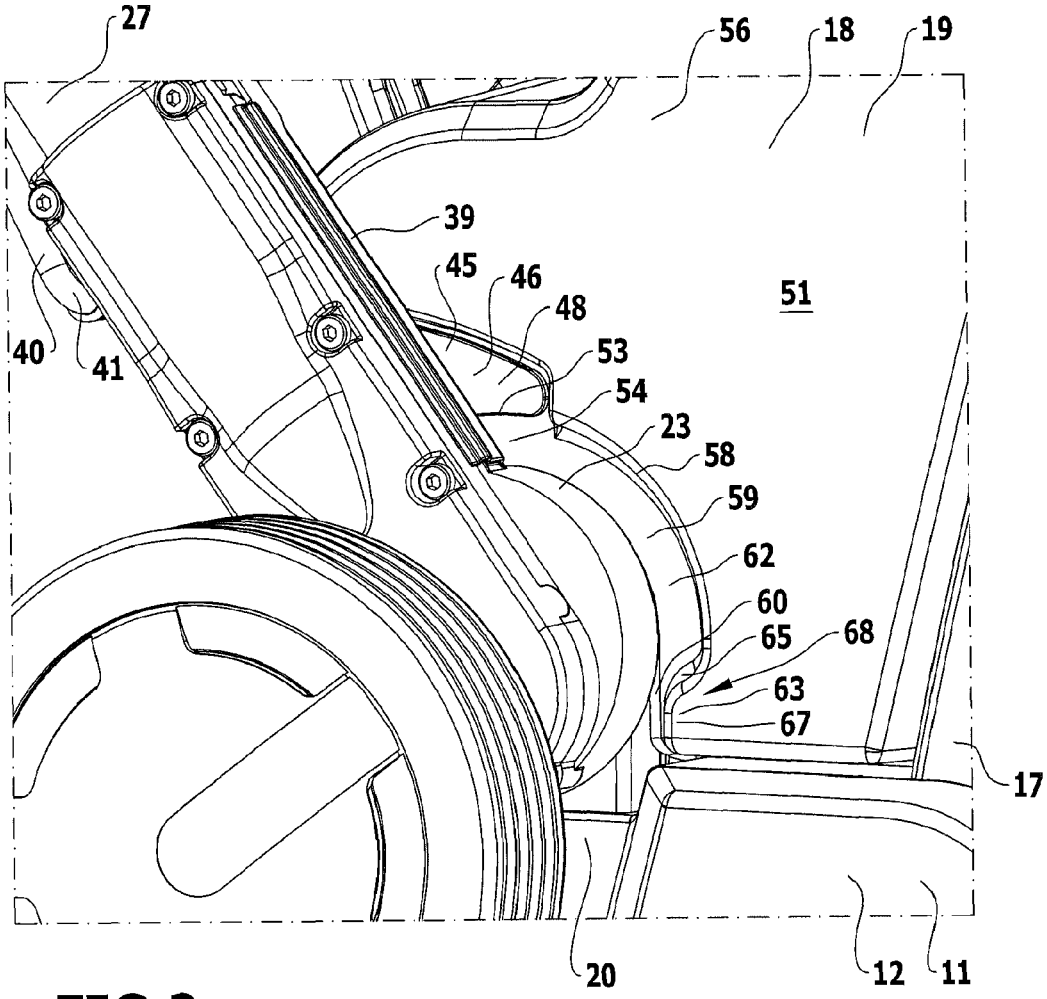
FIG. 2 shows an enlarged view of detail A in FIG. 1.

As already mentioned, the right-hand side wall 51 of the tank 19 is stepped. As best becomes clear from FIGS. 2 to 4, the side wall 51 forms a first upper wall portion 56, which extends in the direction of the pivot axis 25 proceeding from an upper side wall 57 of the tank 19. At a step 58, the first wall portion 56 merges into a second wall portion 59, which is axially offset with respect to the pivot axis 25. The second wall portion 59 in turn merges at a further step 60 into a third wall portion 61, which is axially offset with respect to the pivot axis 25 and is in turn connected to the base wall 30.

The joint 23 engages in the lateral recess formed by the third wall portion 61. The first portion 46 of the lever 45 is arranged in the lateral recess formed by the second wall portion 59 and the cam 38 moves parallel to the wall portion 59 when the handle device 26 is pivoted about the pivot axis 25.

Following the contour 53 of the first portion 46, the step 58 runs between the wall portions 56 and 59 in an arc of a circle shape with respect to the pivot axis 25. The length of the circular arc approximately corresponds to a quarter circle, in the view of FIG. 3, approximately from the vertical to the horizontal in the clockwise direction. Therefore, the second wall portion 59, adjoining the path 54, forms a guide path 62 for the cam 38. In the radial direction, the guide path 62 is limited by the step 58. Furthermore, at the lower end, the step 58 forms a radial projection 63 with respect to the pivot axis 25, the guide path 62 ending at said projection.

Figure 5:
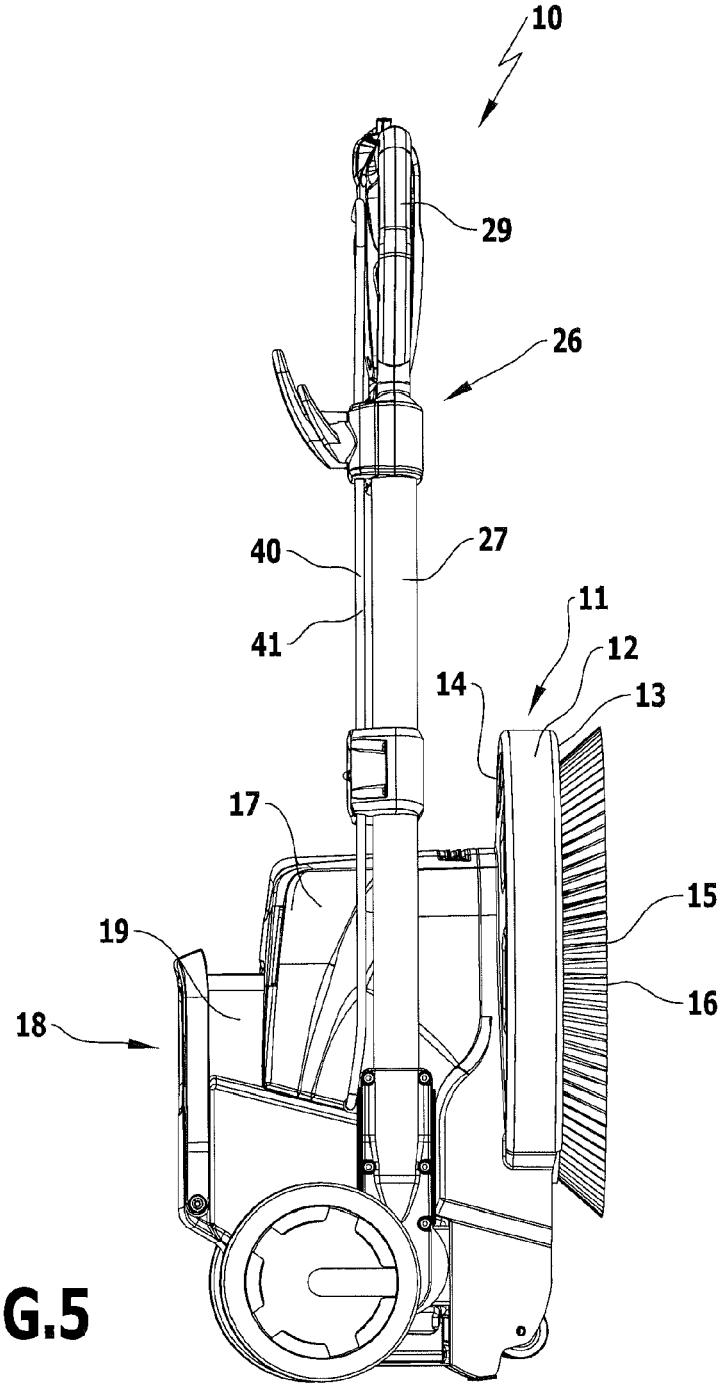
FIG. 5 shows a side view of the floor treating apparatus according to FIG. 1, the handle device adopting a parking position.
Figure 6:
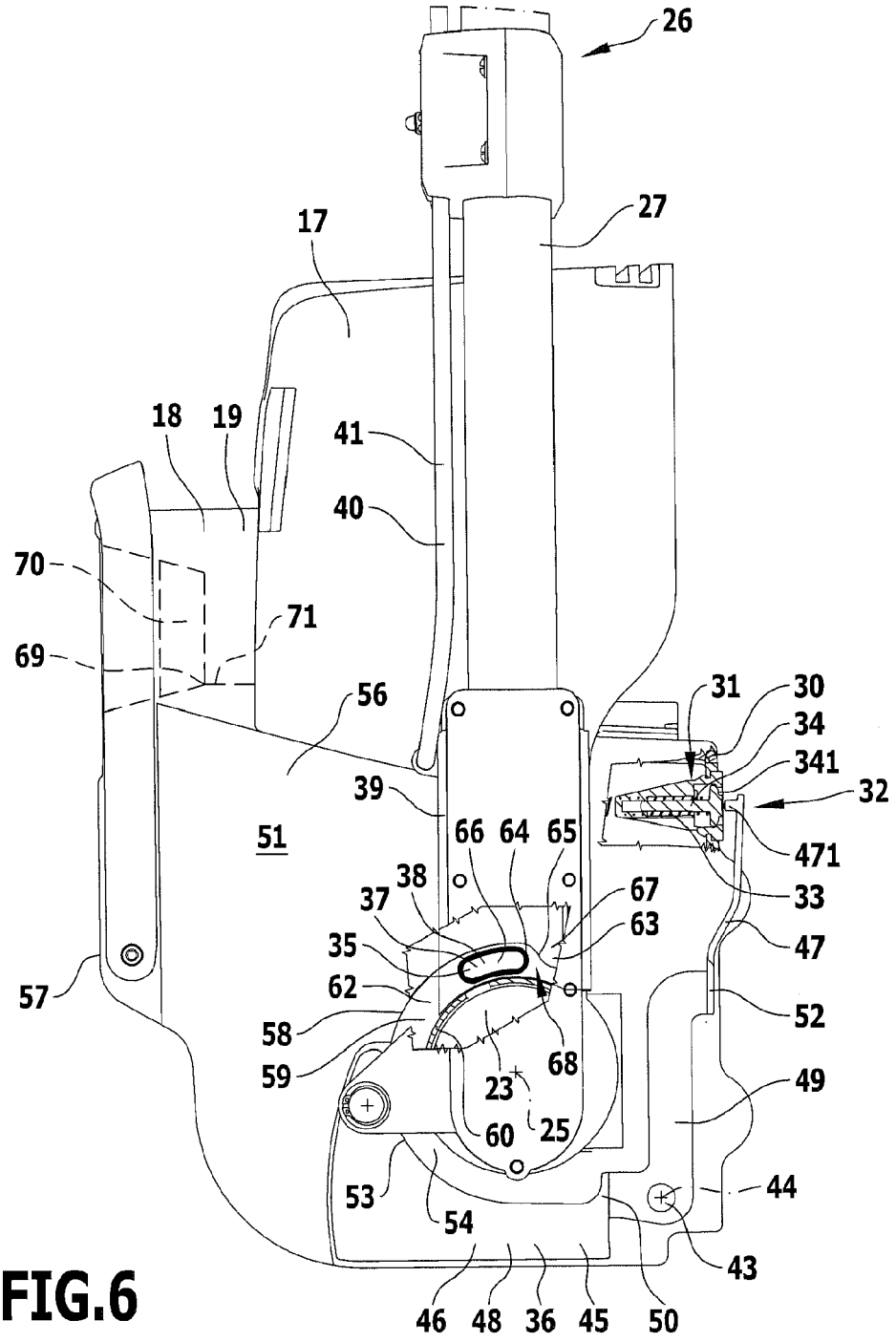
FIG. 6 shows a schematic side view of the storage container and a motor housing of the floor treating apparatus from FIG. 1 and its handle device in a parking position, partly in section.

The handle device 26 may, for example to transport the single disc machine 10 or put it out of service, be transferred from the plurality of working positions into a parking position. This takes place in that it is pivoted about the pivot axis 25 in such a way that the handle struts 27 and 28 are pivoted laterally past the tank 19 until they are arranged in a horizontal plane and parallel to said plane defined by the base 12. In this parking position, the handle device 26 can be locked on the base 12, and the single disc machine 10 can, for example, be placed upright for space-saving storage in such a way that the handle device 26 is vertically oriented (FIGS. 5 and 6).

During the pivoting into the parking position, the cam 38 is guided with some play by the guide path 62 and moved closer to the projection 63. In the parking position of the handle device 26, the cam 38 and projection 63 almost contact one another, and mutually facing contact faces 64 on the cam 38 or 65 on the projection 23 only have a small spacing of a few millimeters.

The cam 38 and the projection 63 may cooperate to secure the tank 19 in the storage container receptacle 22 when the handle device 26 adopts its parking position. If an attempt is actually made to bring the tank 19 in the direction defined by the arrow 55 to a spacing relative to the base 12, the projection 63 is moved toward the cam 38. This leads to the contact faces 64 and 65 being able to cooperate, so the cam 38 blocks the projection 63. Consequently, it is not possible to remove the tank 19 from the storage container receptacle 22 when the handle device 26 adopts its parking position. For this reason, the cam 38 is also called the first securing member 66 and the projection 63 is also called the second securing member 67 of the single disc machine 10. The securing members 66 and 67 together form a securing device 68 to secure the tank 19 in the storage container receptacle 22. They cooperate in a securing position when the handle device 26 adopts the parking position.

On the other hand, if the handle device 26 adopts a working position, the cam 38 and the projection 63 are arranged at a spacing from one another and do not cooperate, so they adopt a release position. In this release position, the tank 19 can be removed without tools from the storage container receptacle 22 and can be positioned therein.

The securing of the tank 19 in the storage container receptacle 22, in a way, takes place "automatically" by pivoting the handle device 26 into the parking position. Moreover, it is also effective when the single disc machine 10, as shown in FIGS. 5 and 6, is stored away with a vertically oriented handle device 26. The tank 19, in this case, does produce a horizontally oriented tilting moment with respect to the base 12. A counter-tilting moment can, however, be applied by the securing members 66 and 67 adopting the securing position. Even in the position shown in FIGS. 5 and 6 of the single disc machine 10, the tank 19 can therefore not fall out of the storage container receptacle 22.

An unintentional actuation of the valve 31 is also ruled out when the handle device 26 adopts the parking position as the cam 38 is then located in the guide path 62. Cooperation with the lever 45 is not possible even when a pulling force acts on the handle 42.

The single disc machine 10 according to an aspect of the invention is particularly easy for a user to handle in the manner described above, the tank locking and tank unlocking being able to take place automatically by pivoting the handle device 26. As the cam 38 can be used both to lock the tank 19 and also to actuate the valve 31, the single disc machine 10 moreover has a particularly simple structural configuration.

The tank 19 may be filled with the treatment liquid by way of a filling opening 69, which can be closed by means of a lid 70 (FIGS. 3 and 6). The filling opening 69 is arranged at a spacing from the upper side 57. As a result, the maximally achievable liquid level 71 also has a spacing from the upper side 57 during operation of the single disc machine 10, and an empty reservoir 72 for the treatment liquid is formed laterally next to the lid 70 above the liquid level 71 (FIG. 3).

If the single disc machine 10 is stored away with the filled tank 19 with a vertical handle device 26 adopting the parking position, treatment liquid located below the lid 70 during working operation flows into the reservoir 72. The liquid level 71, in this case, reaches maximally up to the edge of the filling opening 69 (FIG. 6). This prevents treatment liquid being able to escape from the tank 19, even if the lid 70 should not be tight.

The invention claimed is:

1. A floor treating apparatus, comprising a support device, on the lower side of which there is held at least one floor treating tool, which is driven to rotate or oscillate, a handle device to guide the floor treating apparatus in at least one working position, which handle device is held on the support device so as to be pivotable about a pivot axis from the at least one working position into at least one parking position and vice versa, and a storage container for a treatment liquid for application to the floor surface to be treated, wherein the floor treating apparatus comprises a storage container receptacle, in which the storage container is releasably positionable in the at least one working position of the handle device, as well as a securing device with at least one first securing member and at least one second securing member which is movable relative thereto, which securing members are transferable, by pivoting the handle device into the at least one parking position, into a securing position, in which they cooperate to secure the storage container in the storage container receptacle.

2. The floor treating apparatus according to claim 1, wherein the storage container is securable solely by means of the securing device in the storage container receptacle when the handle device adopts the at least one parking position.

3. The floor treating apparatus according to claim 1, wherein the at least one first securing member is held on the handle device and wherein the at least one second securing member is held on the storage container.

4. The floor treating apparatus according to claim 1, wherein at least one of the at least one first securing member and the at least one second securing member are configured as projections projecting from the handle device in the direction of the storage container and from the storage container in the direction of the handle device, respectively.

5. The floor treating apparatus according to claim 1, wherein the at least one first securing member and the at least one second securing member form stops that are effective along a removal direction of the storage container from the storage container receptacle.

6. The floor treating apparatus according to claim 5, wherein the stops are stop faces running transverse to the removal direction.

7. The floor treating apparatus according to claim 1, wherein the at least one first securing member and the at least one second securing member are located in a common plane oriented perpendicular to the pivot axis and are spaced apart to an identical extent from the pivot axis.

8. The floor treating apparatus according to claim 1, wherein the at least one second securing member is formed integrally with a wall of the storage container.

9. The floor treating apparatus according to claim 1, wherein the at least one second securing member is arranged laterally on the storage container.

10. The floor treating apparatus according to claim 1, wherein the handle device comprises two handle struts, which are spaced apart from one another and between which the storage container is arranged.

11. The floor treating apparatus according to claim 1, wherein the floor treating apparatus comprises a guide path for guiding at least one securing member when pivoting the handle device from the at least one working position into the at least one parking position and vice versa.

12. The floor treating apparatus according to claim 11, wherein the guide path is in the form of a circular arc with respect to the pivot axis.

13. The floor treating apparatus according to claim 11, wherein the guide path is formed integrally with a wall of the storage container.

14. The floor treating apparatus according to claim 11, wherein the guide path is arranged laterally on the storage container.

15. The floor treating apparatus according to claim 11, wherein the at least one second securing member is formed as a radial projection, with respect to the pivot axis, of a limit member of the guide path.

16. The floor treating apparatus according to claim 1, wherein the at least one first securing member and the at least one second securing member are transferable, by pivoting the handle device from the at least one parking position into the at least one working position, from the securing position into a release position, in which they do not cooperate.

17. The floor treating apparatus according to claim 1, wherein the storage container receptacle is formed on an upper side of the support device.

18. The floor treating apparatus according to claim 1, wherein the storage container has a valve for the treatment liquid to discharge and wherein the floor treating apparatus comprises a valve actuating device with at least one first actuating member and at least one second actuating member cooperating therewith to actuate the valve.

19. The floor treating apparatus according to claim 18, wherein the valve is installed in a base wall of the storage container.

20. The floor treating apparatus according to claim 18, wherein the at least one first actuating member is held on the handle device and wherein the at least one second actuating member is held on the storage container.

21. The floor treating apparatus according to claim 18, wherein the at least one first actuating member and the at least one second actuating member in the at least one working position of the handle device are decoupled from one another or are decouplable by removing the storage container from the storage container receptacle.

22. The floor treating apparatus according to claim 18, wherein a portion of the at least one second actuating member cooperating with the at least one first actuating member is arranged above the at least one first actuating member.

23. The floor treating apparatus according to claim 18, wherein at least one securing member forms an actuating member.

24. The floor treating apparatus according to claim 18, wherein the at least one first actuating member is displaceably mounted on the handle device along the longitudinal direction thereof.

25. The floor treating apparatus according to claim 24, wherein the valve actuating device comprises a triggering element for a user, the triggering element being arranged on the handle device and coupled to the at least one first actuating member.

26. The floor treating apparatus according to claim 18, wherein the at least one second actuating member on the storage container is configured as an actuating lever that can be tilted about a tilting axis.

27. The floor treating apparatus according to claim 26, wherein the tilting axis is oriented parallel to the pivot axis.

28. The floor treating apparatus according to claim 18, wherein the at least one second actuating member is arranged laterally on the storage container.

29. The floor treating apparatus according to claim 28, wherein the at least one second actuating member has a first portion arranged laterally on the storage container as well as a second portion arranged below the storage container.

30. The floor treating apparatus according to claim 18, wherein the at least one second actuating member, on its side facing the at least one first actuating member, has a circular arc shaped contour with respect to the pivot axis.

31. The floor treating apparatus according to claim 30, wherein the contour of the at least one second actuating member is formed as an extension of a guide path for at least one securing member.

32. The floor treating apparatus according to claim 1, wherein the floor treating apparatus is a floor cleaning machine.

* * * * *